US007148774B1

(12) United States Patent
Shea et al.

(10) Patent No.: US 7,148,774 B1
(45) Date of Patent: Dec. 12, 2006

(54) CONTACT ASSEMBLY

(75) Inventors: John J. Shea, Pittsburgh, PA (US); Jeffrey A. Miller, McKees Rocks, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/178,839

(22) Filed: Jul. 11, 2005

(51) Int. Cl.
*H01H 83/00* (2006.01)

(52) U.S. Cl. ..... 335/16; 335/147; 335/195; 218/22

(58) Field of Classification Search ..... 335/16, 335/147, 195; 200/244
See application file for complete search history.

(56) References Cited

U.S. PATENT DOCUMENTS 2,211,412 A * 8/1940 Filko ..... 200/244
3,646,488 A * 2/1972 Iida et al. ..... 335/16
4,849,590 A * 7/1989 Becker et al. ..... 218/33
5,029,301 A * 7/1991 Nebon et al. ..... 335/16
5,910,760 A 6/1999 Malingowski et al.
6,452,470 B1 9/2002 Malingowski et al.
6,831,536 B1 12/2004 Zindler

* cited by examiner

*Primary Examiner*—Elvin Enad
*Assistant Examiner*—Bernard Rojas
(74) *Attorney, Agent, or Firm*—Martin J. Moran

(57) ABSTRACT

A circuit breaker contact assembly includes a line conductor having a folded back fixed contact end, a fixed contact mounted on the contact end, and a movable contact arm having an inner edge and first and second ends. A movable contact is mounted on the first end. The movable contact arm is pivotable about the second end between a closed position in which the inner edge extends adjacent the contact end with the movable contact in contact with the fixed contact to form a reverse current loop, and an open position in which the movable contact is pivoted away from the fixed contact. The contact arm includes a first inner longitudinal member extending along the inner edge and a second outer longitudinal member. The first inner longitudinal member has a higher electrical conductivity than the second outer longitudinal member, which has a higher shear strength and a lower specific density.

5 Claims, 5 Drawing Sheets

CONTACT ASSEMBLY

BACKGROUND OF THE INVENTION

1. Field of the Invention

The present invention relates generally to circuit interrupters and, more particularly, to contact assemblies for circuit breakers.

2. Background Information

Circuit interrupters, such as circuit breakers, are employed in diverse capacities in power distribution systems. A circuit breaker may include, for example, a line conductor, a load conductor, a fixed contact and a movable contact, with the movable contact being movable into and out of electrically conductive engagement with the fixed contact. This switches the circuit breaker between an on or closed position and an off or open position, or between the on or closed position and a tripped or tripped off position. The fixed contact is electrically conductively engaged with one of the line and load conductors, and the movable contact is electrically conductively engaged with the other of the line and load conductors. The circuit breaker may also include an operating mechanism having a movable contact arm upon which the movable contact is disposed.

Normally, a movable contact arm is made of solid copper or alloys of copper (e.g., silver bearing copper; a copper alloy with a relatively small percentage of silver), which is a relatively good conductor of both electricity and heat, but which is not as strong as other materials. Hence, it is believed that relatively more copper than is necessary to handle the current (e.g., for thermal conductivity considerations) is typically employed in conventional movable contact arms to handle the current and to provide the needed strength (e.g., rigidity), which adds weight and, thus, increases the moment of inertia.

The structure of the circuit breaker operating mechanism and a contact assembly including the line conductor, fixed contact, movable contact and movable contact arm are designed such that it is desirable to provide current interruption in about a half-cycle, such that the resulting arc is extinguished by the line zero crossing.

There is room for improvement in contact assemblies for circuit breakers.

SUMMARY OF THE INVENTION

These needs and others are met by the present invention, which greatly improves the short-circuit interruption performance of circuit breakers, such as molded case circuit breakers (MCCBs), by increasing the opening angular velocity of the movable contact arm of the contact assembly.

As one aspect of the invention, a contact assembly for a circuit breaker comprises: a line conductor having a folded back fixed contact end; a fixed contact mounted on the fixed contact end of the line conductor; a movable contact; and a movable contact arm having an inner edge, an outer edge, a first end and a second end, the movable contact mounted on the first end, the movable contact arm being pivotable about the second end between a closed position in which the inner edge extends adjacent the folded back fixed contact end of the line conductor with the movable contact in contact with the fixed contact to form a reverse current loop and an open position in which the movable contact is pivoted away from the fixed contact, the movable contact arm having a cross section that is narrower in width toward the outer edge opposite the inner edge than at the inner edge.

The movable contact arm may further have side edges between the inner edge and the outer edge, the side edges tapering inward toward the outer edge.

A height of the movable contact arm between the inner edge and the outer edge may be greater than a width of the movable contact arm at the inner edge.

The movable contact arm may comprise a first inner longitudinal member and a second outer longitudinal member, the first inner longitudinal member having a higher electrical conductivity than the second outer longitudinal member and the second outer longitudinal member having a higher shear strength than the first inner longitudinal member.

The second outer longitudinal member may have side edges that taper inward toward the outer edge.

The first inner longitudinal member may be made of copper.

The second outer longitudinal member may be selected from a group comprising aluminum and an aluminum alloy.

At least one of the first inner longitudinal member and the second outer longitudinal member may have a cross section including a height and a width, the height being greater than the width.

As another aspect of the invention, a contact assembly for a circuit breaker comprises: a line conductor having a folded back fixed contact end; a fixed contact mounted on the fixed contact end of the line conductor; a movable contact; and a movable contact arm having an inner edge, a first end and a second end, the movable contact mounted on the first end, the movable contact arm being pivotable about the second end between a closed position in which the inner edge extends adjacent the folded back fixed contact end of the line conductor with the movable contact in contact with the fixed contact to form a reverse current loop and an open position in which the movable contact is pivoted away from the fixed contact, the movable contact arm comprising a first inner longitudinal member extending along the inner edge and a second outer longitudinal member, the first inner longitudinal member having a higher electrical conductivity than the second outer longitudinal member and the second outer longitudinal member having a higher shear strength and a lower specific density than the first inner longitudinal member.

The first inner longitudinal member may comprise copper.

The second outer longitudinal member may be made of a material selected from a group comprising aluminum and an aluminum alloy.

At least one of the first inner longitudinal member and the second outer longitudinal member may have a cross section including a height and a width, the height being greater than the width.

The second outer longitudinal member may be narrower at the outer edge than at an edge facing the first inner longitudinal member.

The second outer longitudinal member may have an inverted T-shaped cross section.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

The movable contact arms disclosed herein preferably concentrate current at the inner edge of the movable contract arm, in order to increase the opening force, and, also, preferably reduce the moment of inertia of the movable contact arm. Together, this results in a relatively more rapid opening and, therefore, a relatively lower "let through" current (i.e., the current that flows while the circuit breaker is opening), which is an important parameter of circuit breaker performance. Examples 1 and 2, below, disclose two ways of accomplishing these results.

EXAMPLE 1

Figure 1:
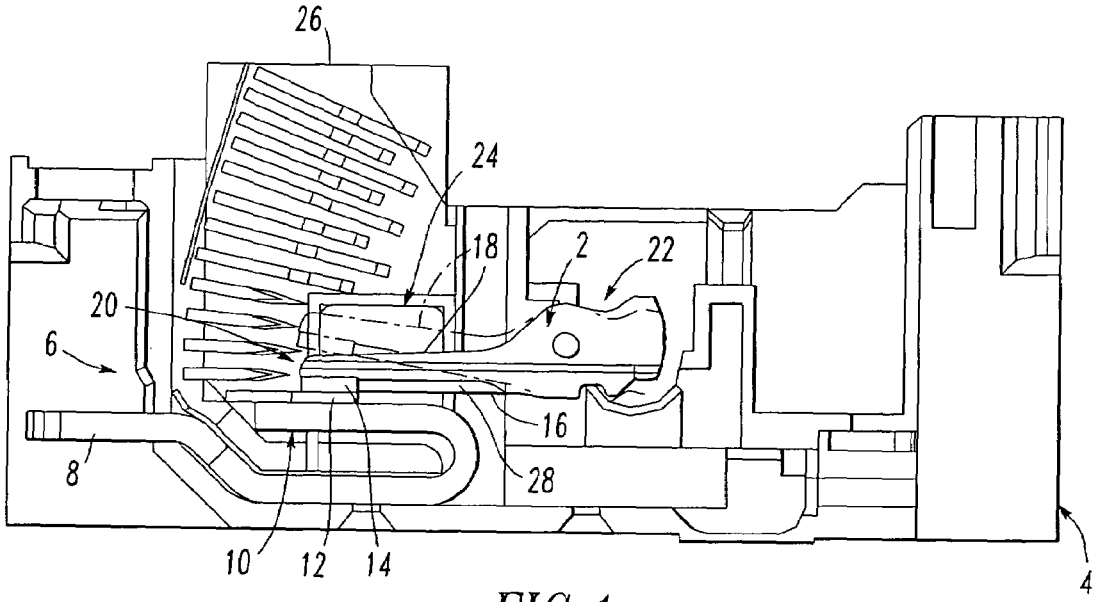
FIG. 1 is a vertical elevation view of a movable contact arm shown in a molded case circuit breaker in accordance with the present invention.

FIG. 1 shows a movable contact arm 2 as employed in a molded case circuit breaker (MCCB) 4. A contact assembly 6 for the MCCB 4 includes a line conductor 8 having a folded back fixed contact end 10, a fixed contact 12 mounted on the line conductor fixed contact end 10, a movable contact 14, and the movable contact arm 2. The movable contact arm 2 has an inner edge 16, an outer edge 18, a first end 20 and a second end 22. The movable contact 14 is mounted on the first end 20. The movable contact arm 2 is pivotable about the second end 22 between a closed position (as shown in FIG. 1) in which the inner edge 16 extends adjacent the folded back fixed contact end 10 with the movable contact 14 in electrical and mechanical contact with the fixed contact 12 to form a reverse current loop and an open position (shown in phantom line drawing in FIG. 1) in which the movable contact 14 is pivoted away from the fixed contact 12.

Figure 8A:
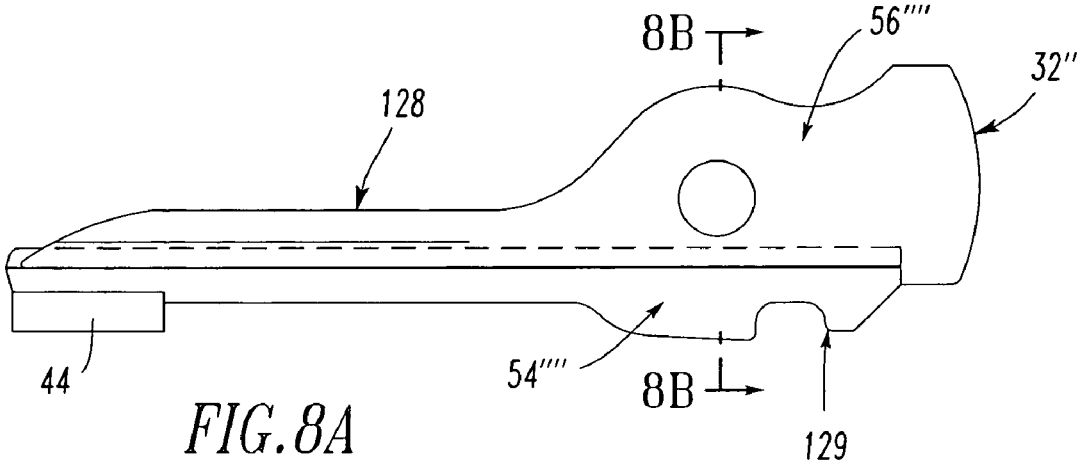
FIG. 8A is a vertical elevation view of a movable contact arm in accordance with another embodiment of the invention.
Figure 8B:
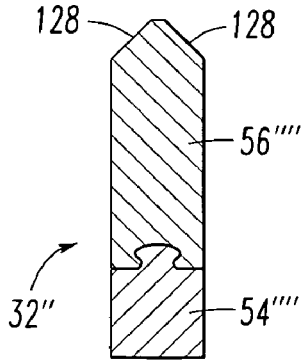
FIG. 8B is a cross-sectional view along lines 8B—8B of FIG. 8A.
Figure 10:
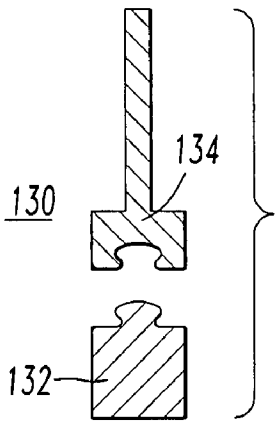
FIG. 10 is a cross-sectional view of a movable contact arm in accordance with another embodiment of the invention.

In accordance with an important aspect of the invention, in the manner as shown, for example with the movable contact arms 32" or 130 of respective FIG. 8B or 10, the movable contact arm 2 has a cross section that is narrower in width toward the outer edge 18 opposite the inner edge 16 than at the inner edge 16. The movable contact arm 2 is, thus, relatively narrow in cross section toward the outer edge 18. This achieves the first objective by providing relatively less material at the outer edge 18 for current to flow through, thereby forcing current down toward the inner edge 16. Hence, the current flowing in opposite directions in the fixed line conductor 8 and the movable contact arm 2 are closer to each other, thereby creating an increased repulsion force on the arm 2. This achieves the second objective by reducing the total mass that needs to be accelerated. However, the current density rises, such that the amount of tapering is limited by temperature rise restrictions and mechanical constraints.

In this example, the movable contact arm 2 also has beveled edges 28 (only one is shown in FIG. 1) on each side thereof for further weight reduction.

The example MCCB 4, as shown, may also include a suitable narrow-channel low-profile slot motor 24 and an arc chute 26.

EXAMPLE 2

Figure 2:
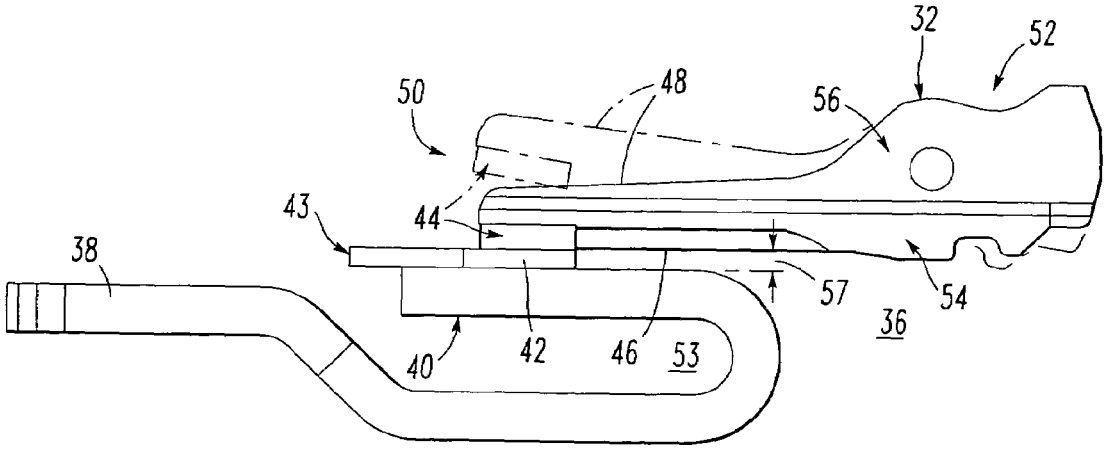
FIG. 2 is a vertical elevation view of a hybrid movable contact arm including a copper lower section coupled to an aluminum or aluminum alloy upper section in accordance with another embodiment of the invention.

FIG. 2 shows a hybrid movable contact arm 32 of a contact assembly 36. The contact assembly 36 includes a line conductor 38 having a folded back fixed contact end 40, a fixed contact 42 mounted on the line conductor fixed contact end 40, an arc runner 43, and a movable contact 44. The movable contact arm 32 has an inner edge 46, an outer edge 48, a first end 50 and a second end 52. The movable contact 44 is mounted on the first end 50 and is pivotable about the second end 52 between a closed position (as shown in FIG. 2) in which the inner edge 46 extends adjacent the folded back fixed contact end 40 with the movable contact 44 in electrical and mechanical contact with the fixed contact 42 to form a reverse current loop 53 and an open position (shown in phantom line drawing in FIG. 2) in which the movable contact 44 is pivoted away from the fixed contact 42. The movable contact arm 32 includes a first inner longitudinal member 54 extending along the inner edge 46 and a second outer longitudinal member 56. The first inner longitudinal member 54 has a higher electrical conductivity than the second outer longitudinal member 56 and the second outer longitudinal member 56 having a higher shear strength and a lower specific density than the first inner longitudinal member 54.

Preferably, the first inner or lower (with respect to FIG. 2) longitudinal member 54 is made of copper and is suitably coupled to the second outer or upper (with respect to FIG. 2) longitudinal member 56, which is made of aluminum or an aluminum alloy. The movable contact arm 32 is, thus, a two-material contact arm including an inner part (along the inner edge 46) having a relatively high electrical and thermal conductivity (e.g., without limitation, copper) and an outer part (along the outer edge 48) having a relatively high tensile and shear strength, low specific density (e.g., light weight) and relatively lower electrical conductivity (e.g., without limitation, aluminum; aluminum alloy) than the inner part.

The fact that the outer part has a relatively lower electrical conductivity helps to push the current downward to increase the opening force.

In this example, unlike the movable contact arm 2 of FIG. 1, the first inner longitudinal member 54 does not have the beveled edges 28 (FIG. 1).

A relatively reduced gap 57 between the reverse loop 53 and the movable contact arm 32 increases the opening velocity of the contact arm.

EXAMPLE 3

Although aluminum and an aluminum alloy are disclosed, any suitable relatively high tensile and shear strength, low specific density (e.g., light weight) and relatively lower electrical conductivity material may be employed. As a non-limiting example, a suitable material made from molding plastic resin with carbon fibers may be employed.

EXAMPLE 4

As a non-limiting example, the first inner longitudinal member 54 of FIG. 2 has a length of about 2.224 inches and a width of about 0.187 inches. The second outer longitudinal member 56 has a length of about 2.421 inches and a width of about 0.187 inches. The overall height of the movable contact arm 32 is about 0.688 inches.

EXAMPLE 5

The first inner longitudinal member 54 may be suitably bonded to the second outer longitudinal member 56.

EXAMPLE 6

Figure 9A:
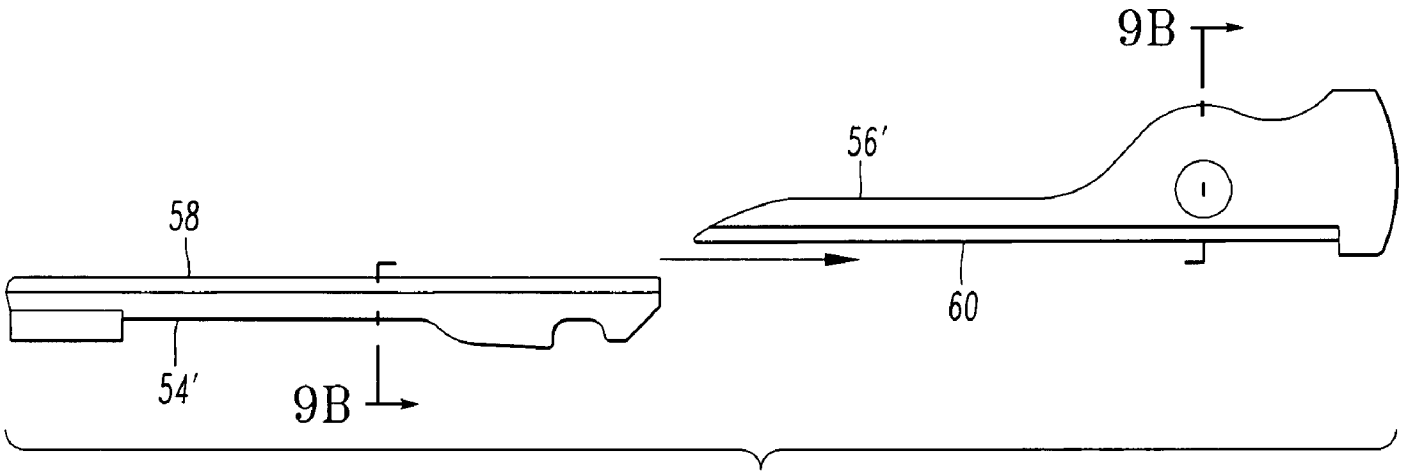
FIG. 9A is an exploded vertical elevation view of a hybrid movable contact arm in accordance with another embodiment of the invention.
Figure 9B:
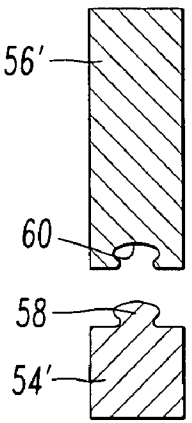
FIG. 9B is a cross-sectional view along lines 9B—9B of FIG. 9A.

FIGS. 9A and 9B show a first inner longitudinal member 54' having a tongue portion 58 being suitably coupled to a second outer longitudinal member 56' having a corresponding mating groove portion 60.

EXAMPLE 7

Figure 7:
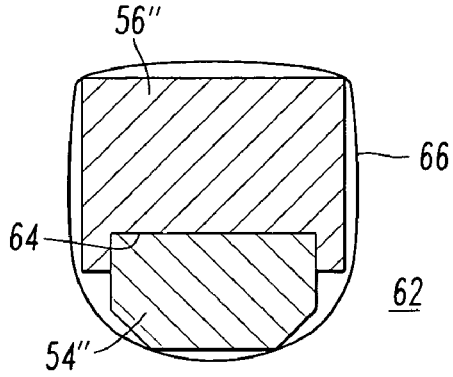
FIG. 7 is a cross-sectional view of a movable contact arm in which two diverse materials are banded together in accordance with another embodiment of the invention.

In addition to mechanical interference (e.g., without limitation, tongue and groove), a wide variety of suitable methods may be employed to join or otherwise couple the two dissimilar contact arm materials. Various example methods include cold welding; rivets and/or screwing with mechanical fasteners; mechanical clips; mechanical banding; soldering; brazing; welding; and ultrasonic welding. For example, FIG. 7 shows a movable contact arm 62 in which a first inner longitudinal member 54" (e.g., made of copper) is suitably coupled to a second outer longitudinal member 56" (e.g., made of aluminum; aluminum alloy) having a recess 64 for the member 54" in which the members 54",56" are coupled by a band 66.

EXAMPLE 8

Figure 3:
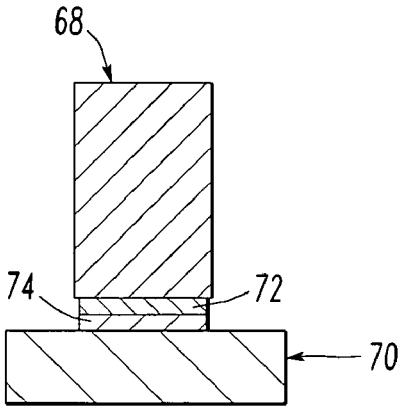
FIG.3 PRIOR ART
FIG. 3 is a simplified cross-sectional view of conventional movable contact arm geometry.
Figure 5A:
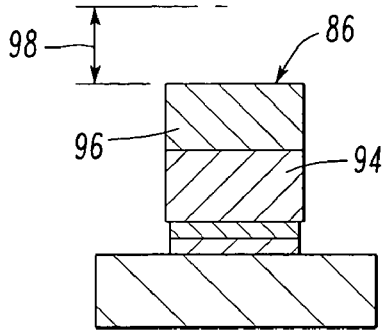
FIGS. 5A–5D are simplified cross-sectional views of hybrid movable contact arms employing copper and an aluminum or an aluminum alloy in accordance with other embodiments of the invention.

FIG. 3 shows a view of a conventional movable contact arm 68 and reverse loop 70 having, respectively, a movable contact 72 and a fixed contact 74.

Figure 4A:
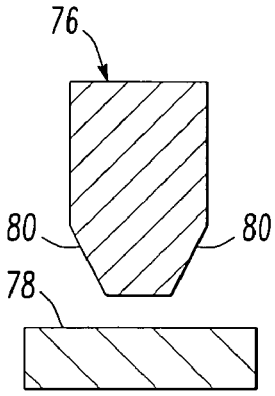
FIGS. 4A–4C are simplified cross-sectional views of movable contact arm geometries in accordance with other embodiments of the invention.
Figure 4B:
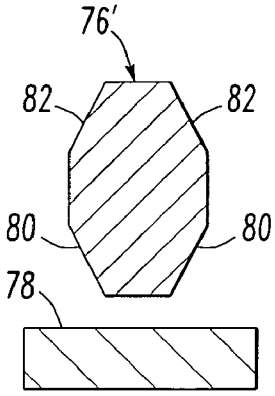
Figure 4C:
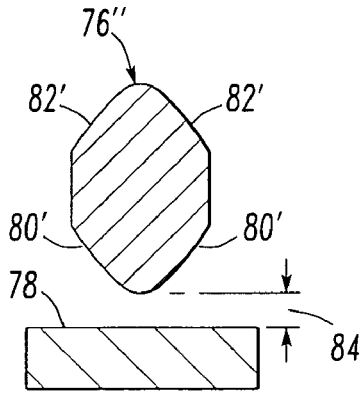

FIGS. 4A–4C show simplified views of movable contact arms 76,76',76" and a reverse loop 78. For simplicity of illustration, the movable contact 72 and the fixed contact 74 of FIG. 3 are not shown. The movable contact arm 76 employs beveled or chamfered lower (with respect to FIG. 4A) corners 80 for a reduced moment of inertia. The movable contact arm 76' employs beveled or chamfered lower and upper (with respect to FIG. 4B) corners 80,82 for further weight reduction and for enhanced magnetic repulsion. The movable contact arm 76" employs relatively greater beveled or chamfered lower and upper (with respect to FIG. 4C) corners 80',82' for still further weight reduction. In this example, the copper chamfered corners 82,82' move the average current density down toward the stationary conductor of the reverse loop 78 with respect to FIGS. 4B and 4C.

The movable contact arm 76 of FIG. 4A reduces contact arm mass and enhances magnetic field contact arm repulsion. The movable contact arms 76',76" of FIGS. 4B and 4C reduce contact arm mass and enhance magnetic field contact arm repulsion. A reduction in movable contact arm mass reduces the moment of inertia around the pivot point (not shown) of the contact arm. For example, mass reduction near the end of the contact arm (at the movable contact end) has a relatively greater effect on the moment of inertia reduction than removing the mass near the pivot point. A reduced moment of inertia increases the angular opening velocity for a given current. Also, a reduction in the gap 84 (as shown in FIG. 4C) between the reverse loop 78 and the movable contact arm 76" also increases the opening velocity of the movable contact arm. As shown in FIGS. 4B and 4C, the movable contact arms 76',76" may further have side edges between the inner edge and the outer edge, with the side edges tapering inward toward the outer edge.

EXAMPLE 9

Further enhancements to magnetic force result from moving the effective current path in the movable contact arm closer to the reverse loop 78 by being able to reduce the height of the movable contact arm since, as was discussed above in connection with FIG. 2, the upper section of the contact arm may be made from a relatively stronger material, such as an aluminum alloy, than the lower section, which may be made of copper. For example, an aluminum alloy has a higher resistivity than copper, thereby, forcing more of the current to pass through the lower copper member which is located in relatively closer proximity to the reverse loop. A height of the movable contact arm between the inner edge and the outer edge may be greater than a width of the movable contact arm at the inner edge. This also increases the strength of the movable contact arm.

EXAMPLE 10

A wide range of other suitable arm geometries, especially in the lightweight reinforcing member (e.g., made of aluminum; an aluminum alloy), may be employed that allow for further weight reduction (e.g., without limitation, an I-beam; holes; machined ribs; rods).

EXAMPLE 11

A wide range of other suitable materials and/or suitable contact arm geometries may be employed. For example, a suitable relatively good conductive material (e.g., without limitation, copper) is reinforced with a suitably high strength material with reasonably good thermal properties (e.g., without limitation, aluminum).

EXAMPLE 12

Furthermore, there are a wide range of suitable alloys of these materials that work with various suitable tempers and hardnesses. For example, suitable example copper alloys include CDA 15500 (e.g., without limitation, temper T60), CDA 11000, CDA 10100, CDA 10200, CDA 10400, CDA 11100, CDA 11500 and CDA 12500. Suitable aluminum alloys include 7068, 7075 (e.g., without limitation, temper T651), 6262 and 2024.

EXAMPLE 13

An intermediate layer (e.g., brass) (not shown) may be advantageously employed to bridge the difference in the coefficient of thermal expansion (CTE) between the two different movable contact arm materials to prevent, for example, delamination or cracking of the interface therebetween, especially if welding or brazing is employed to join the different materials. Furthermore, the aluminum may also be plated (e.g., nickel plated), in order to improve bonding characteristics.

EXAMPLE 14

Some example different movable contact arm materials (CTE values in mm/mm/8C) include copper (1.8), brass (2.0) and aluminum (2.3).

EXAMPLE 15

FIGS. 5A–5D show simplified hybrid movable contact arms 86,88,90,92. The arm 86 employs a lower (with respect to FIG. 5A) copper portion 94 and an upper (with respect to FIG. 5A) aluminum or aluminum alloy portion 96. An aluminum alloy further reduces the mass of the movable contact arm 86 and the moment of inertia and forces current into the lower copper portion 94 for increased blow-open force. Also, by selecting a suitable high yield strength aluminum alloy (e.g., without limitation, a 7068, 7075 or 6262 alloy), this allows further weight reduction by reducing, as shown at 98, the height of the movable contact arm 86. Such alloys also have a higher resistivity than aluminum alloy 1100 (i.e., commercially pure aluminum) which forces relatively more current through the lower copper portion 94.

Figure 5B:
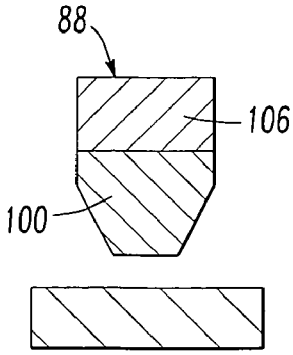
Figure 5C:
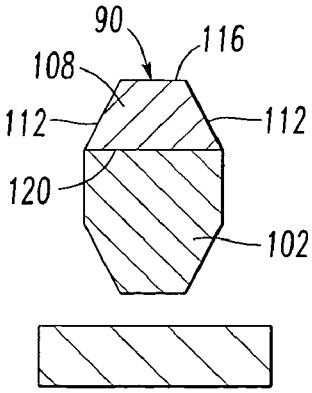
Figure 5D:
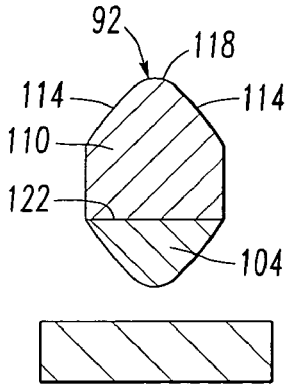

As shown in FIGS. 5B–5D, the movable contact arms 88,90,92 include first inner longitudinal members 100,102, 104 and second outer longitudinal members 106,108,110, respectively. The first inner longitudinal members 100,102, 104 have a higher electrical conductivity than the respective second outer longitudinal members 106,108,110, which have a higher shear strength than the respective first inner longitudinal members 100,102,104. The first inner longitudinal members 100,102,104 are made of copper. The second outer longitudinal members 106,108,110 are made of aluminum or an aluminum alloy. One or both of the first inner longitudinal members 100,102,104 and the second outer longitudinal members 106,108,110 have a cross section including a height and a width, with the height being greater than the width. This improves the strength of the movable contact arms 88,90,92.

As shown in FIGS. 5C and 5D, the second outer longitudinal members 108,110 have side edges 112,114 that taper inward toward the outer edges 116,118, respectively. The second outer longitudinal members 108,110 are narrower at the outer edges 116,118 than at the edges 120,122 facing the first inner longitudinal members 102,104, respectively.

EXAMPLE 16

Figure 6:
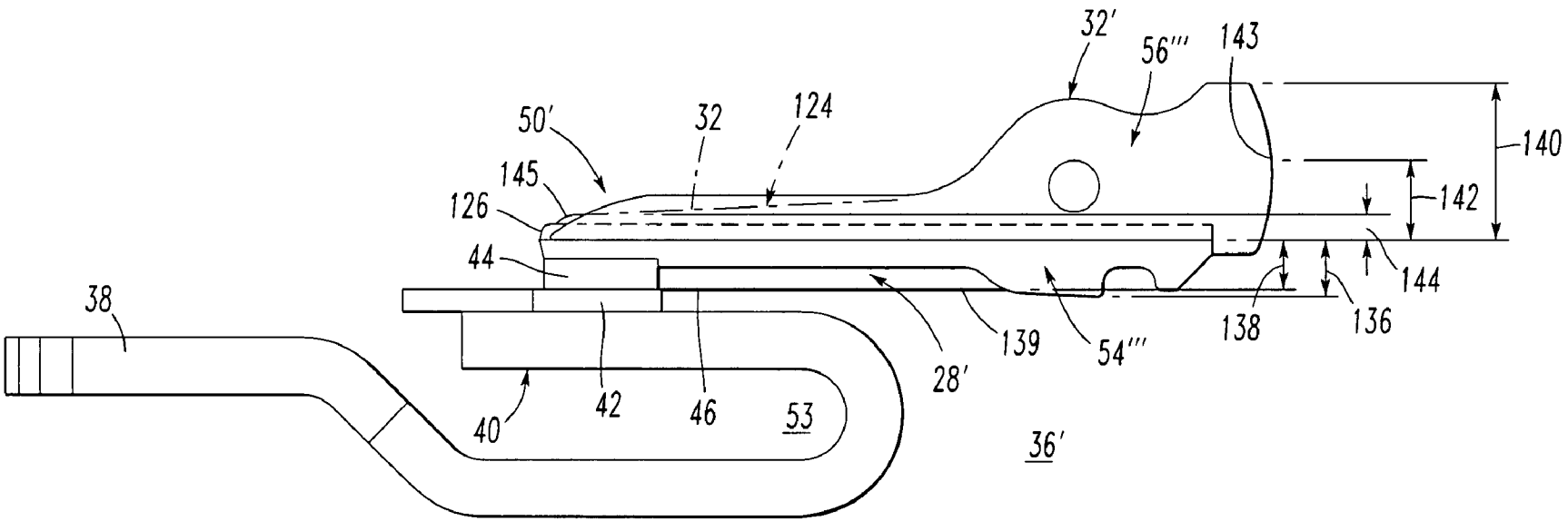
FIG. 6 is a vertical elevation view of a movable contact arm having an aluminum section and a reverse current loop in accordance with another embodiment of the invention.

FIG. 6 shows another hybrid movable contact arm 32' of a contact assembly 36', which is somewhat similar to the contact assembly 36 of FIG. 2. For convenience of reference, the movable contact arm 32 of FIG. 2 is shown in phantom line drawing. Somewhat similar to the movable contact arm 2 of FIG. 1, the movable contact arm 32' has two 45° beveled portions 28' (only one beveled portion is shown) on each side for weight reduction. The movable contact arm 32' includes a first inner copper longitudinal member 54''' extending along inner edge 46' and a second outer aluminum or aluminum alloy longitudinal member 56'''. As contrasted with the second outer longitudinal member 56 of FIG. 2, the second outer longitudinal member 56''' has an increased thickness at the nose end 50' for added strength. Also, in contrast, the second outer longitudinal member 56 of FIG. 2 has beveled edges 124 (only one edge is shown in phantom line drawing in FIG. 6) for reduced weight. Finally, the first inner longitudinal member 54''' has a tip portion 126, which extends past the end of the second outer longitudinal member 56''', for preventing melting of the aluminum, from the arc, during interruption. Hence, the thickness and the profile of the movable contact arm 32 of FIG. 2 are increased for added strength to prevent bending, especially at short-circuit currents above 100 kA where even faster opening velocities and forces are expected.

EXAMPLE 17

FIGS. 8A and 8B show another hybrid movable contact arm 32", which is somewhat similar to the movable contact arm 32' of FIG. 6. The movable contact arm 32" has one 45° beveled portion 128 (as best shown in FIG. 8B) on the top side of the second outer aluminum or aluminum alloy longitudinal member 56“ ” for weight reduction. The movable contact arm 32" also includes a first inner copper longitudinal member 54“ ” having a portion 129 to which a suitable shunt (not shown) for a line terminal (not shown) is electrically connected.

EXAMPLE 18

FIG. 10 shows another hybrid movable contact arm 130 including a first inner copper longitudinal member 132 and a second outer aluminum or aluminum alloy longitudinal member 134 having an inverted T-shaped cross section. This reduces the weight, but suitably maintains the relative strength of the second outer member 134.

EXAMPLE 19

As a non-limiting example, the ratio of copper-to-aluminum may be about 2:1 by weight.

For example, for the hybrid movable contact arm 32 of FIG. 2 (as shown with the beveled edges 124 of FIG. 6), the maximum height 136 of the first inner longitudinal member 54 (FIG. 2) may be about 0.1767 inches, with an average height 138 of about 0.1446 inches with respect to surface 139. Also, the maximum height 140 of the second outer longitudinal member 56 (FIG. 2) may be about 0.5109 inches, with an average height 142 of about 0.2420 inches with respect to point 143, and with a minimum height 144 of about 0.0861 inches with respect to end 145.

The disclosed movable contact arms 2,32,32',32",62,76, 76',76",86,88, 90,92,130 provide increased contact arm velocity by reducing the mass of the movable contact arm and by increasing the magnetic field "seen" by the movable contact arm. This may be achieved by combining a suitable relatively lightweight, yet relatively strong, material with a suitable current-carrying material in order to produce a hybrid, two-material contact arm. This may also be achieved by suitably shaping and profiling a movable contact arm, which may be made of one or more materials. These geometries allow for low-cost, mass production quantities suitable for MCCBs while still maintaining desirable current carrying, thermal, and interruption properties. The disclosed movable contact arms may readily be incorporated into existing circuit breakers without any changes to existing moldings or to the operating mechanisms. Mold changes and operating mechanism changes are very costly especially after high volume production has begun.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A contact assembly for a circuit breaker, said contact assembly comprising:

a line conductor having a folded back fixed contact end;

a fixed contact mounted on the fixed contact end of the line conductor;

a movable contact; and a movable contact arm having an inner edge, an outer edge, a first end and a second end, the movable contact mounted on the first end, the movable contact arm being pivotable about the second end between a closed position in which the inner edge extends adjacent the folded back fixed contact end of the line conductor with the movable contact in contact with the fixed contact to form a reverse current loop and an open position in which the movable contact is pivoted away from the fixed contact, the movable contact arm having a cross section that is narrower in width toward the outer edge opposite the inner edge than at the inner edge, wherein the movable contact arm comprises a first inner longitudinal member and a second outer longitudinal member, the first inner longitudinal member having a higher electrical conductivity than the second outer longitudinal member and the second outer longitudinal member having a higher shear strength than the first inner longitudinal member.

2. The contact assembly of claim 1 wherein the second outer longitudinal member has side edges that taper inward toward the outer edge.

3. The contact assembly of claim 1 wherein the first inner longitudinal member is made of copper.

4. The contact assembly of claim 3 wherein the second outer longitudinal member is selected from a group comprising aluminum and an aluminum alloy.

5. The contact assembly of claim 3 wherein at least one of the first inner longitudinal member and the second outer longitudinal member has a cross section including a height and a width, said height being greater than said width.

* * * * *